US005257613A

United States Patent [19]

Monda et al.

[11] Patent Number: 5,257,613

[45] Date of Patent: Nov. 2, 1993

[54] ENGINE CONTROL SYSTEM

[75] Inventors: Takashi Monda; Tomiharu Yokoyama; Mitsuhiro Maruyama, all of Hiroshima, Japan

[73] Assignee: Mazda Motor Corporation, Hiroshima, Japan

[21] Appl. No.: 723,496

[22] Filed: Jun. 28, 1991

[30] Foreign Application Priority Data

Jun. 29, 1990 [JP] Japan ..... 2-174106

[51] Int. Cl.[5] ..... F02D 41/14; F02M 25/08

[52] U.S. Cl. ..... 123/674; 123/698

[58] Field of Search ..... 123/494, 520, 674, 698

[56] References Cited

U.S. PATENT DOCUMENTS 4,961,412 10/1990 Furuyama ..... 123/520
4,977,881 12/1990 Abe et al. ..... 123/674
5,048,492 9/1991 Davenport et al. ..... 123/674
5,048,493 9/1991 Orzel et al. ..... 123/674
5,070,847 12/1991 Akiyama et al. ..... 123/674
5,090,388 2/1992 Hamburg et al. ..... 123/674

FOREIGN PATENT DOCUMENTS 62-59220 3/1987 Japan .

*Primary Examiner*—Willis R. Wolfe
*Attorney, Agent, or Firm*—Keck, Mahin & Cate

[57] ABSTRACT

An engine control system corrects an air-fuel ratio of an air and fuel mixture during feedback control in a feedback region of engine operating conditions and during a learning control in a learning region of engine operating conditions. A purge region of engine operating conditions, in which purging of fuel vapor into the engine is conducted, is defined so as to have a portion overlapping with the learning control region. The air-fuel learning and the fuel vapor purging are conducted alternately. A specific region of engine operating conditions is defined in the purge region for higher flow rates of intake air. The control system undergoes the air-fuel learning prior to the fuel vapor purge when engine operating conditions are in this specific region.

13 Claims, 5 Drawing Sheets

ENGINE CONTROL SYSTEM

The present invention relates to a control system for an automobile engine which performs a learning control for adjusting an air-fuel ratio of a mixture of air and fuel. More particularly, this invention relates to an engine control system of an automobile engine, in which a fuel vapor purge is conducted, having a learning control for adjusting the air-fuel ratio of the mixture.

BACKGROUND OF THE INVENTION

1. Field of the Invention

An engine control system, which performs learning control for adjusting an air-fuel ratio of a mixture of air and fuel, typically detects an air-fuel ratio of the mixture in order to calculate a correction value to bring the actual air-fuel ratio into line with a desired ratio. Such an adjustment or correction is accomplished by the use of the correction value in a feedback control. The control system is also typically used for adjusting the correction value so as to bring a basic fuel injection rate up or down to an appropriate rate. Because the physical properties of fuel injectors and fuel supply systems generally deteriorate due to aging, deviations of the actual air-fuel ratio from an ideal or desired value are produced. The learning control of an air-fuel ratio is useful, in an engine control system, to bring an actual air-fuel ratio back to the ideal or desired air-fuel ratio. Such an engine control system is known from, for instance, Japanese Patent Publication No. 62 - 59220.

2. Description of Related Art

Engine control systems, such as that disclosed by the Japanese publication referred to, typically have an engine provided with a fuel vapor purge system for preventing fuel vapor, generated in a fuel tank, from escaping into the atmosphere. When the air-fuel ratio learning control is conducted in a system including an engine having a fuel vapor purge system, however, its difficult to bring a basic fuel injection value back to a desired value, due to fuel vapor purged into the intake system. This is because when a zone in which the air-fuel ratio learning control is effected overlaps with a zone in which the fuel vapor purge is effected, the learning control for modifying the air-fuel ratio is executed during the purge of fuel vapor.

In order to eliminate adverse effects, produced by purging fuel vapor, on the learning control for adjusting an air-fuel ratio, it is desirable to have the engine control system alternate periodically between the purge of fuel vapor and the learning control for adjusting the air-fuel ratio, so that the purge of fuel vapor is suspended during execution of the learning control, and to increase the frequency of execution of purging the fuel vapor. However, if purging of fuel vapor is conducted alternately with the learning control in an engine having what is known as a "hot-wire" type of air flow sensor for detecting a flow rate of intake air introduced into the engine, a zone of engine operating conditions in which it is hard to control the air-fuel ratio with high accuracy is present. In short, the hot-wire type air flow sensor typically has a detection error which is small in a range of low air flow rates, but which becomes large as the air flow rate becomes higher. Hence, in the range of high intake air flow rates, even if a rate of fuel supplied supposedly corresponds to a flow rate of intake air actually detected by the hot-wire type air flow sensor, deviations in the air-fuel ratio occur easily. It takes a long time until the basic rate of fuel injection is brought to an appropriate rate, due to the deviations, as long as the learning control for adjusting the air-fuel ratio and the fuel vapor purge are alternately executed.

SUMMARY OF THE INVENTION

It is a primary object of the invention to provide an engine control system for an engine, having a hot-wire type of air flow sensor, in which an air-fuel ratio learning control and a fuel vapor purge are alternately conducted in a zone of engine operating conditions overlapping zones of engine operating conditions assigned to the air-fuel ratio learning control and fuel vapor purging, respectively.

It is another object of the invention to provide an engine control system for an engine having a hot-wire type of air flow sensor which learns an air-fuel ratio in order to bring a fuel injection rate to an appropriate rate in a short period of time, even in a zone of engine operating conditions in which the hot-wire type of air flow sensor has a low accuracy in detecting intake air flow rate.

In order to achieve these objects, the present invention provides a particular engine control system which controls an automotive engine, equipped with an intake system having a hot wire type of air flow sensor for detecting an air flow rate of intake air introduced into the intake system and a vapor fuel purge system for purging fuel vapor into the intake system in a predetermined purge zone of engine operating conditions. The engine control system corrects an air-fuel ratio of the air and fuel mixture, in feedback control, throughout a wide range of engine operating conditions, and learns and renews an air-fuel ratio of the mixture in a predetermined learning zone of engine operating conditions. The predetermined purge zone is established so as to have a portion which overlaps with the predetermined learning control zone.

The air-fuel ratio learning and fuel vapor purge are caused to operate alternately at a predetermined frequency when an engine operating condition is in the portion of the predetermined purge zone which overlaps with the predetermined learning control zone. The air-fuel ratio learning is executed prior to the fuel vapor purge when an engine operating condition is detected to be in a predetermined specific zone in which the engine needs intake air at a high flow rate.

BRIEF DESCRIPTION OF THE DRAWINGS

The above and other objects and features of the present invention will be apparent from the following description of preferred embodiments thereof when considered in conjunction with the associated drawings, in which.

DETAILED DESCRIPTION OF THE PREFERRED EMBODIMENTS

Figure 1:
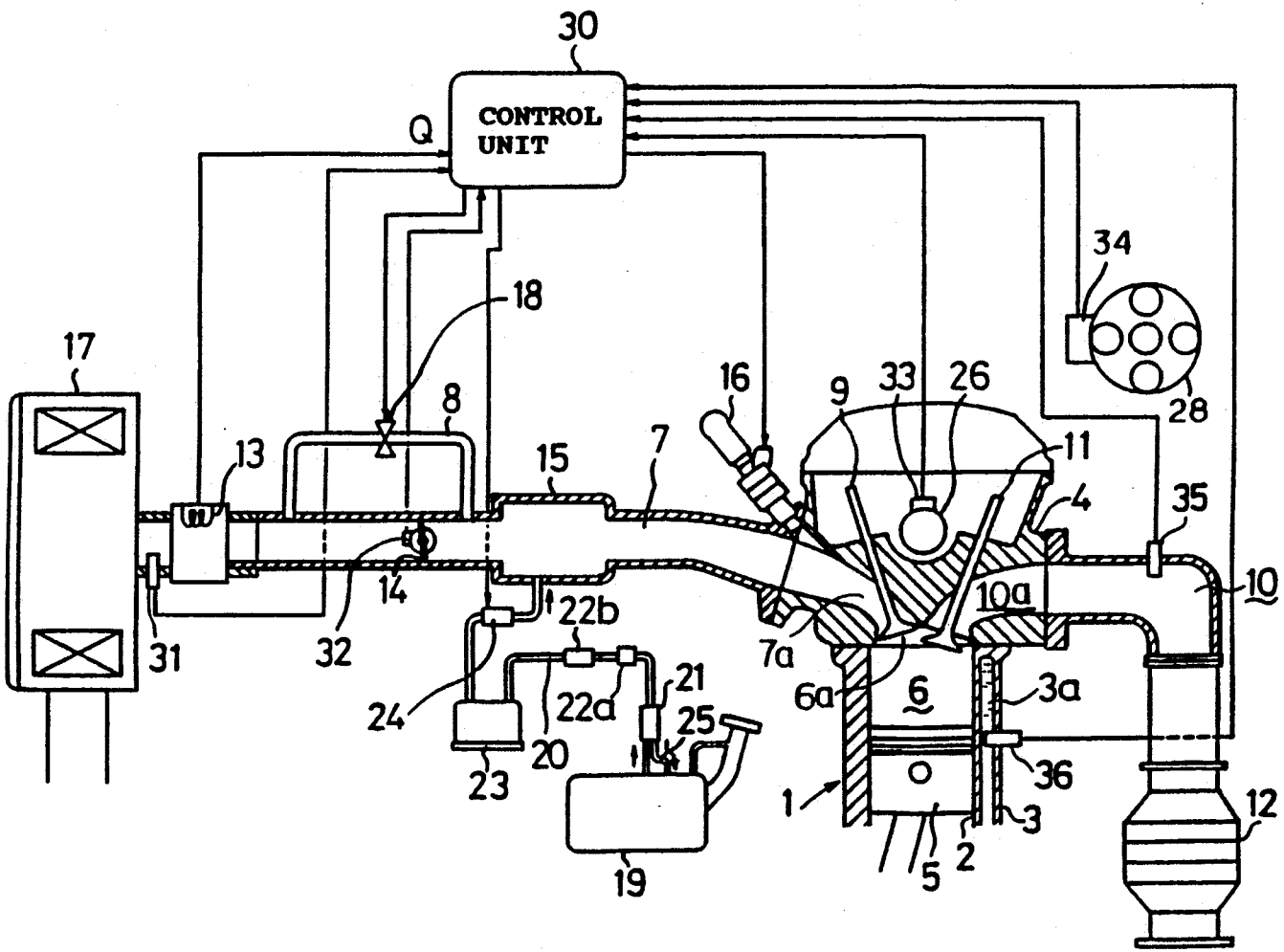
FIG. 1 is a schematic illustration of an engine controlled by an engine control system in accordance with a preferred embodiment of the present invention.

Referring to the drawings in detail and, in particular, to FIG. 1, an engine body 1 of an overhead camshaft engine, equipped with an engine control system in accordance with a preferred embodiment of the present invention, is shown. The engine body 1 has a cylinder block 3 provided with a plurality of cylinders 6, formed by cylinder bores 2 (only one of which is shown), in which pistons 5 can reciprocate and which are surrounded by a water jacket 3a. A cylinder head 4 is mounted on the cylinder block 3. A combustion chamber 6a is formed in each cylinder 6 by the top of the piston 5, a lower wall of the cylinder head 4 and the cylinder bore 2. The cylinder 6 is provided with an intake port 7a and an exhaust port 10a having openings which extend towards the opposite sides of the exhaust port 10a open into the combustion chamber 6a, and are opened and shut at a predetermined timing by intake and exhaust valves 9 and 11, respectively. The cylinder head 4 mounts thereon a camshaft 26.

The engine body 1 is equipped with an air intake system, including an intake passage 7 in communication with the intake port 7a, for introducing air into the cylinder 6. The engine body 1 is further equipped with an exhaust passage 10, which is in communication with the exhaust port 10a, for discharging burned gases from the cylinder 6 and in which a catalytic converter 12 is provided.

Intake passage 7 is provided, in order from the upstream end thereof, with an air cleaner 7 connected to the upstream end, a hot-wire type of air flow sensor 13 for detecting a volumetric air flow ratio Q, a throttle valve 14 for regulating an air flow ratio, a surge tank 15 for controlling pulsations of intake air, and a fuel injector 16 for injecting fuel into the intake air.

Figure 2:
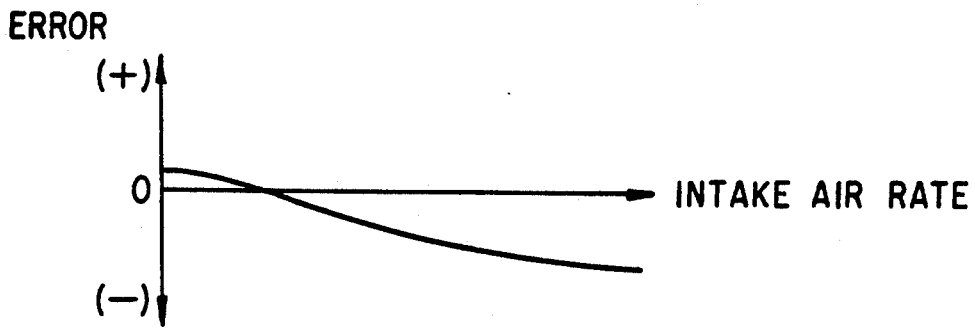
FIG. 2 is a diagram showing characteristics of a hot wire type air flow sensor.

Hot-wire air flow sensor 13, which itself is well known in the art, generally has changing sensitivity characteristics. That is, as is shown in FIG. 2, the hot-wire air flow sensor 13 has a detection error which is small in a region of low air flow ratios and, accordingly, has a high detection accuracy in the low air flow region. However, as the air flow ratio increases, an apparent air flow rate, i.e., the air flow detected by the hot-wire air flow sensor, becomes smaller than an actual air flow rate. Therefore, as the actual air flow ratio increases, the hot-wire air flow sensor detection accuracy becomes lower.

Referring back to FIG. 1, the intake passage 7 has a bypass passage 8, with an idle speed control (ISC) valve 18, branching off therefrom between the hot-wire air flow sensor 13 and the throttle valve 14. The bypass passage 8 and the idle speed control valve 18, as is well known in the automobile art, function to allow intake air to be introduced into the combustion chamber 6a and regulated, bypassing the throttle valve 14, so as to control an idling speed when the engine 1 is idling.

A fuel tank 19, which is, on one hand, connected to the fuel injector 16 via a fuel supply passage (not shown), is connected to the surge tank 15 via a passage 20 in order to supply vaporized fuel gas in the fuel tank 19 to the engine 1. The passage 20 is equipped with a purge system for purging vaporized fuel into the intake system. The purge system includes a separator 21 for separating liquid fuel contained in the vaporized fuel gas, a two-way valve 22a, a three-way valve 22b, a vapor storage canister 23, and a purge valve 24 provided, in order, from the upstream end (the side of the fuel tank 19) in the passage 20. The purge valve 24 comprises a solenoid valve for opening and closing the passage 20 to regulate the transfer or purge of vaporized fuel gas into the intake passage 7. The separator 21 is connected to the fuel tank 19 via a fuel return passage 25 for returning liquid fuel, separated by the separator 21, into the fuel tank 19.

In order to control operation of the injector 16, idling speed control valve 18 and purge valve 24, the engine control system includes a control unit 30 having a central processing unit (CPU) which receives signals from various sensors in addition to the air flow sensor 13, such as an air temperature sensor 31, a throttle opening sensor 32, a crank angle sensor 33, a distributor angle sensor 34, an exhaust sensor 35 and a water temperature sensor 36. The air temperature sensor 31 is disposed in the intake passage 7 to detect the temperature of fresh air introduced in the intake passage 7 via the air cleaner 17 and provides a signal representative of the temperature of fresh air. The throttle opening sensor 32 is operationally coupled to the throttle valve 14 to detect an opening of the throttle valve 14 and provides a signal representative of the opening. The throttle opening sensor 32 is adapted to additionally provide an idle signal when the throttle valve 14 is fully closed and the engine is idling. The crank angle sensor 33 cooperates with the camshaft 26 to detect a rotated angle of the camshaft 26 as a crank angle of the crankshaft of the engine 1 and provides a signal representative of the rotated angle of the camshaft 26. The distributor angle sensor 34 is incorporated in a distributor 28 for distributing high voltage to the cylinders, to provide a signal representative of a cylinder under voltage distribution. The exhaust sensor 35, disposed in the exhaust passage 10, monitors exhaust of the engine 1 to detect the oxygen content of the exhaust in order to verify the accuracy of the fuel mixture setting and to correct a feedback fuel control system to bring the oxygen concentration back to proper levels, and provides a signal representative of the oxygen content. The water temperature sensor 36, provided in the cylinder block 3, detects the temperature of cooling water within the water jacket 3a and provides a signal representative of the cooling water temperature.

Figure 3:
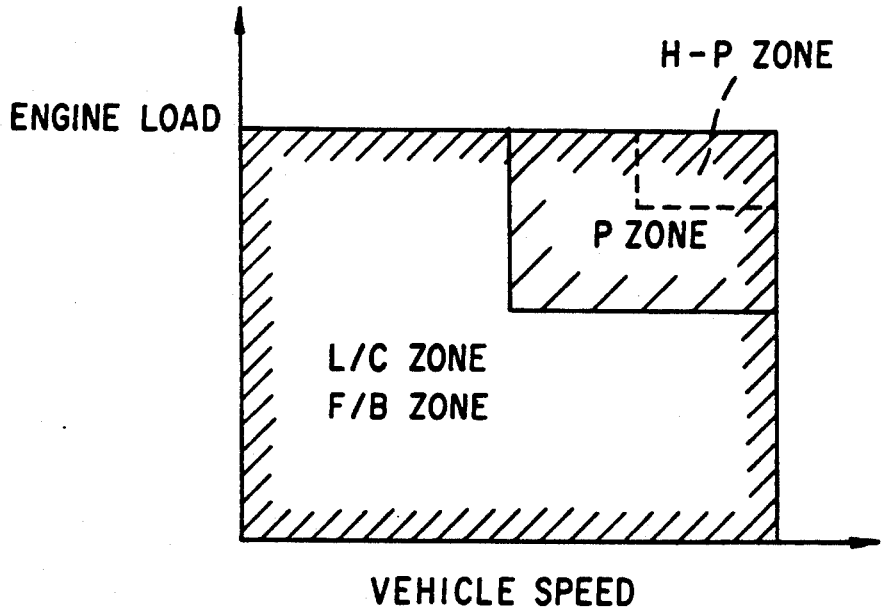
FIG. 3 is a diagram showing various zones of engine operating conditions for various controls.

Feedback fuel control is performed so that the fuel injector 16 sets a proper air-fuel ratio based on the signals from the air flow sensor 13, the distributor angle sensor 34 and the exhaust sensor 35. In order to correct the fuel injection system and bring the air-fuel ratio to a correct value, the engine control system performs correction in an air-fuel ratio learning control throughout the whole zone of possible engine operating conditions, as is represented in FIG. 3. In this embodiment, air-fuel ratio feedback and learning controls are carried out in this zone. The necessity of correction is brought about due to physical degradation caused by aging of the air flow sensor 13, the fuel injector 16 and their associated elements.

As represented in FIG. 3, the purge of fuel vapor into the intake system is carried out, by controlling the purge valve 24, in a "P zone" including a "H-P zone" of high speeds and high engine loads. In the P and H-P zones, air is introduced at a high air flow ratio. As FIG.

3 shows, the predetermined high engine load, high vehicle speed zone or region H-P is included, at higher engine loads and vehicle speeds, in the predetermined purge zone or region P. As long as a large amount of air is introduced into the intake system, the purge of fuel vapor has less effect on the engine performance, even in the air-fuel ratio feedback control region.

Figure 4:
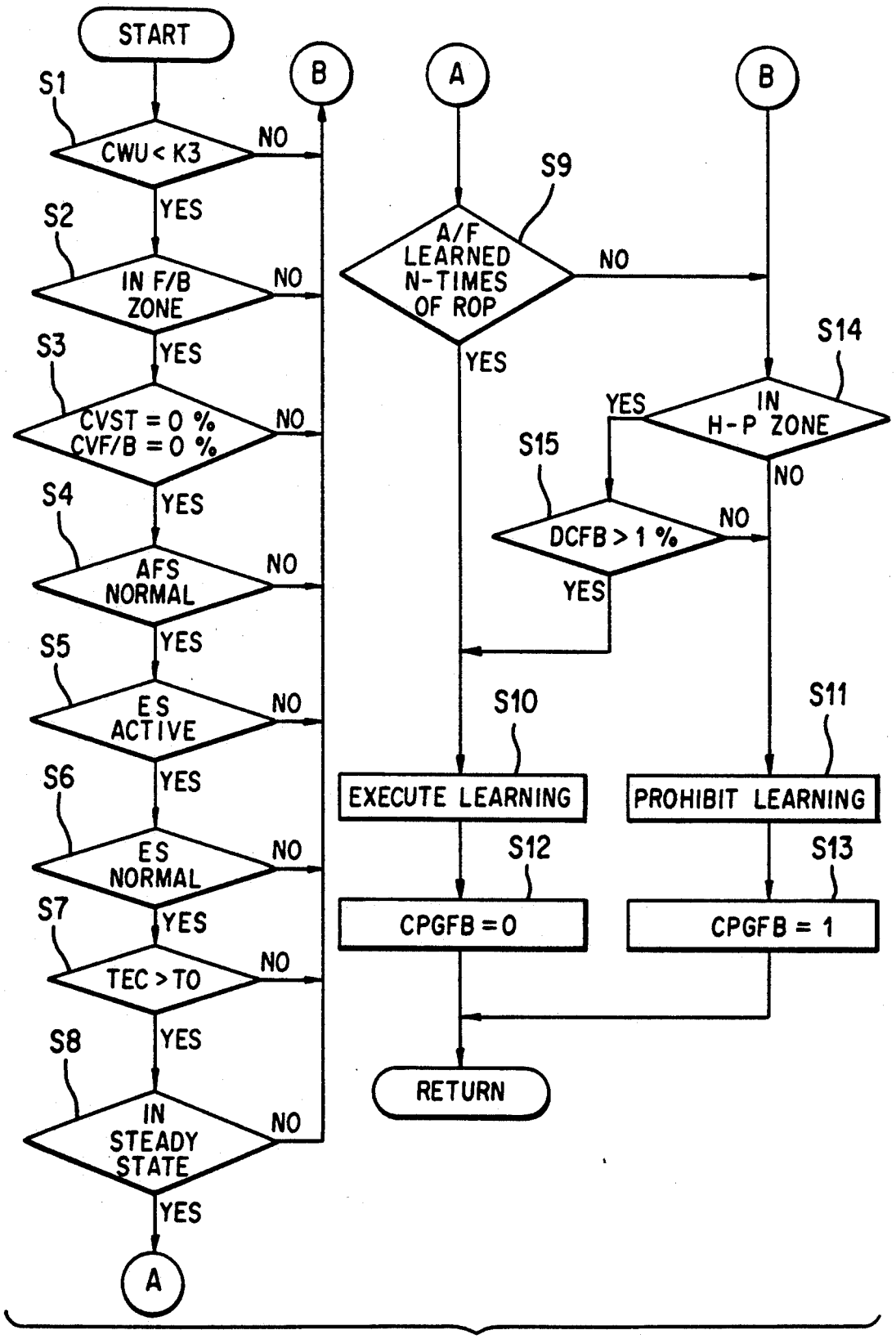
FIG. 4 is a flow chart illustrating a sequence of an air-fuel ratio learning control for a CPU used in the engine control system.
Figure 5:
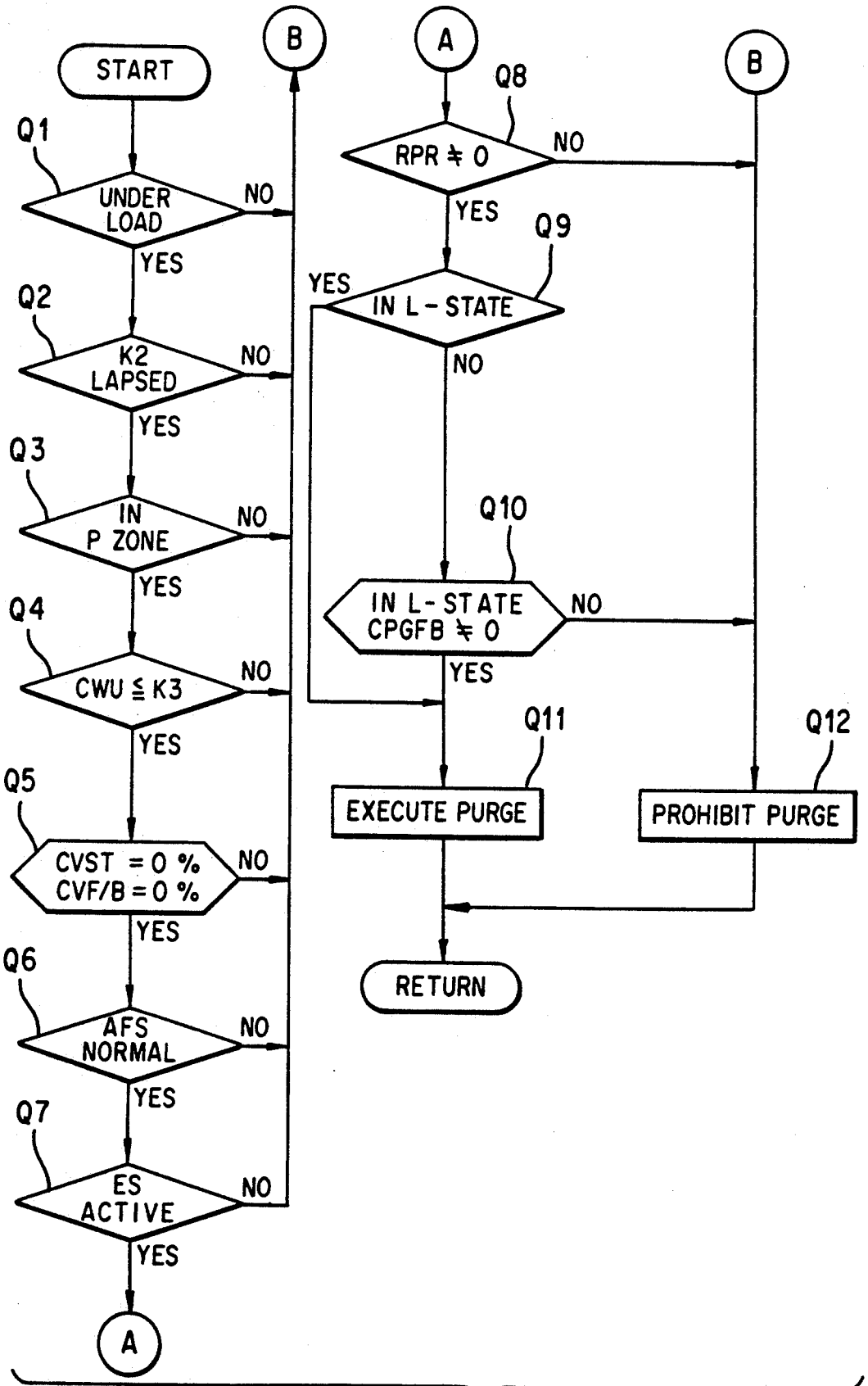
FIG. 5 is a flow chart illustrating a sequence of a fuel vapor purge for a CPU used in the engine control system.

The operation of the engine control system depicted in FIGS. 1-3 is best understood by reviewing FIGS. 4 and 5, which are flow charts illustrating portions of a main routine. More specifically, FIGS. 4 and 5 illustrate an air-fuel learning control routine and a fuel vapor purge control routine, respectively, for the CPU. Programming a computer is a skill well understood in the art. The following description is written to enable a programmer having ordinary skill in the art to prepare an appropriate program for the CPU. The particular details of any such program would, of course, depend upon the architecture of the particular computer selected.

Referring to FIG. 4, which is a flow chart of the air-fuel ratio learning control routine for the CPU, after starting the routine, decisions are made in steps S1-S6 to judge whether a state of engine operating conditions is such that the feedback control of the air-fuel ratio can be conducted and carried out. That is, decisions are made in step S1 as to whether the percentage increase in the rate of fuel supply or consumption (CWU) is smaller than K3 (%) during engine warm-up, i.e., whether warming-up of the engine has ended, in step S2 as to whether a present engine operating condition is in the zone of air-fuel ratio feedback control (F/B) shown in FIG. 3, in step S3 as to whether primary factors representing intentional changes in the air-fuel ratio, such as an increasing fuel quantity value (CVST) at engine starting and a decreasing fuel quantity value (CVF/B) after the end of fuel cut, are both zero (0), in step S4 as to whether the air flow sensor (AFS) 13 is under a proper voltage for normal operation, in step S5 as to whether the exhaust sensor (ES) 35 has been sufficiently activated, and in step S6 as to whether the exhaust sensor 35 is in a normal operating condition for air-fuel ratio detection. It is to be noted that the exhaust sensor provides an output which alternates between high and low levels as long as it operates normally. However, it is possible that the exhaust sensor will continuously provide an output at either the high or the low level for a long period of time. If the output level continues at the high or the low level, or is maintained and not alternated in level, for longer than a predetermined period of time, the exhaust sensor is considered to be operating abnormally.

If any one of the answers to the decisions in steps S1-S6 is no, it is considered impossible to carry out the air-fuel ratio feedback control. Then, because the air-fuel ratio learning control is also considered impossible to conduct, the control routine proceeds to step S11 in order to prohibit any execution of the air-fuel ratio learning control. On the other hand, if all answers to the decisions in steps S1-S6 are yes, it is considered possible to carry out the air-fuel ratio feedback control. Then, a further decision is made in step S7 to examine the possibility of carrying out the air-fuel ratio learning control. Specifically, the decision made in step S7 is whether the temperature of engine coolant (TEC) is above the lower limit (T0) of a temperature range in which the air-fuel ratio learning control is permitted. This step is preferred, because the air-fuel ratio feedback control is conducted from quite a low temperature, and there is a possibility that even after warming up of the engine is completed, an increasing fuel quantity value for engine warming up will still remain. Therefore, it is necessary to detect an engine coolant temperature suitable for the air-fuel ratio learning control separately from the engine warm up condition. If an engine coolant temperature is lower than the lower limit of a previously selected temperature range considered acceptable for the air-fuel ratio learning control, the answer to the decision in step S7 becomes no, indicating that the engine operating conditions are not satisfactory for the air-fuel ratio learning control. Then, the control routine proceeds to step S11 to prohibit execution of the air-fuel ratio learning control. On the other hand, if the answer to the decision in step S7 is yes, indicating that an engine coolant temperature is higher than the lower limit of the temperature range and, accordingly, the engine operating conditions are satisfactory for the air-fuel ratio learning control, a decision is made in step S8 as to whether the engine is in a steady state of operation. When the engine is not in a steady state of operation, i.e., when the engine is in a transient state of operation, such as acceleration or deceleration, in which the air-fuel ratio deviates from a theoretical air-fuel ratio, then, because it is impossible to properly perform learning, the air-fuel ratio learning control is prohibited in step S11. If the answer to the decision is yes, indicating that the engine is in a steady state of operation and all conditions are satisfactory for the engine to conduct the air-fuel ratio learning control, the control routine proceeds to step S9.

In step S9, it is decided whether the air-fuel ratio (A/F) learning has been performed, in the present zone of engine operating conditions, for the air-fuel ratio learning control and whether there has been a reversal of output (ROP) from the exhaust sensor 35 of at least a predetermined number (N) of times after renewal of a learned value in the previous cycle of the air-fuel ratio learning control. Since the rate of deterioration of an exhaust sensor changes according to the rate of intake air introduced into the engine, if a rate of deterioration at a specific intake rate of air is considered to be representative, i.e., the same, for all possible intake rates of air in the air-fuel ratio learning control, large errors in determining an air-fuel ratio will be generated when intake rates of air other than the specific intake rate of air are present. For this reason, in order for the engine control system to perform the air-fuel ratio learning control with high accuracy, engine operating conditions are divided into the same number of zones as there are ranges of intake air rates, so that the air-fuel ratio learning control is properly conducted and learns an air-fuel ratio in each range of intake air intake rates. The air-fuel ratio learned in a respective range of air intake rates is reflected in the air-fuel ratio learning control in the respective range, which is results in a highly accurate air-fuel ratio learning control. On the other hand, because the air-fuel ratio learning control is used to correct deviations of the air-fuel ratio due to deterioration of elements of the fuel system, such as the air flow sensor 13, the fuel injector 16, etc., the air fuel ratio learning control is suspended for a certain period of time so as to purge fuel vapor once an air-fuel ratio has been learned.

If the answer to the decision in step S9 is yes, this indicates either that no learning of air-fuel ratio has been performed in the present range of engine operating conditions or that a predetermined number of reversals of output from the exhaust sensor 35 has passed after the last renewal of the learned value. Consequently, there is a demand for the air-fuel ratio learning control. The air-fuel ratio learning control is then actually carried out in step S10.

To perform the air-fuel ratio learning control, first, an average of correction values (CFBm) is obtained, or calculated, from a number "n" of correction values (CFB) for the air fuel ratio, for feedback control of the air-fuel ratio. Learning of a correction value CLARN(i) for the present air-fuel ratio learning control is performed by using the average correction value CFBm and a correction value CLARN(i−1) for the last learning control according to the following:

$$CLARN(i)=CLARN(i-1)+CFBm/2$$

When the learning of correction value CLARN is carried out in step S10, in order for the control system to suspend purging of the fuel, during execution of an air-fuel ratio learning control, a purge execution flag (CPGFB) is reset to CPGFB=0 (prohibit state) in step S12. The last step orders return.

If the answer to the decision in step S9 is no, this indicates that no air-fuel ratio learning control is required. The air-fuel ratio learning control is then suspended or prohibited in step S11 and the purge execution flag (CPGFB) is set to CPGFB=1 (permission state) in step S13 so as to permit a fuel vapor purge. In any case, after setting or resetting the purge execution flag (CPGFB), the program next orders return to the main routine. In this way, the air-fuel ratio control sequence of FIG. 4 is executed throughout the whole zone of engine operating conditions set for the air-fuel ratio learning control, as shown in FIG. 3, so as to successively renew a learned correction value CLARN(i).

In the sequence of air-fuel ratio learning control illustrated by the flow chart shown in FIG. 4, even if the answer to the decision step S9 is no, which indicates that the exhaust sensor 35 has not reversed its output the predetermined number of times, i.e., that there is no demand to conduct the air-fuel ratio learning control, a decision is made, in step S14, as to whether the quantity of intake air falls in a zone of high engine loads and high vehicle speeds (which is represented by an area H-P in FIG. 3) and, in step S15, as to whether a deviation (DCFB) in a feedback correction value (CFB) of the present air-fuel ratio is as large as 1% or more of a predetermined range of correction values. If the present engine operating condition is in the high engine load, high vehicle speed range H-P and the deviation or error in a feedback correction value (CFB) of the present air-fuel ratio is as large as 1% or more of the predetermined range of correction values, namely, both the answers to the decisions in steps S14 and S15 are yes, the sequence proceeds to step S10 in order to conduct and carry out the air-fuel ratio learning control with a first priority.

However, if the answer to the decision in step S14 is no, or if the answer to the decision in step S14 is yes and the answer to the decision S15 is no, the air-fuel ratio learning control is prohibited in step S11.

Referring to FIG. 5, which is a flow chart of the fuel vapor purge control routine for the CPU of the control unit 30, after starting the routine, decisions are made in steps Q1–Q7 to judge whether the present state of engine operating conditions is one in which either the air-fuel ratio feedback control or the air-fuel ratio learning control may be conducted and carried out. That is, after starting the routine, decisions are made in step Q1 as to whether the engine is operating under load, in step Q2 as to whether a predetermined time K2 has lapsed after the engine has been changed to an off-idle operating condition, in step Q3 as to whether the engine operating condition is in the fuel purge region shown FIG. 3, in step Q4 as to whether a fuel rate increase is less than a predetermined rate K3 set for engine warming-up, in step Q5 as to whether a fuel quantity increasing rate on engine starting and a fuel quantity decreasing rate after the end of fuel cut are both zero (0), in step Q6 as to whether the air flow sensor 13 is under a proper voltage for normal operation, and in step Q7 as to whether the exhaust sensor 35 has been sufficiently activated. If any one of the answers to the decisions in steps Q1–Q7 is no, this indicates that the fuel vapor purge is impossible to conduct. Then, the control routine proceeds to step Q12 in order to prohibit any execution of fuel vapor purge.

On the other hand, if all answers to the decisions in steps Q1–Q7 are yes, this indicates that it is possible to conduct and carry out both the air-fuel ratio feedback control and the fuel vapor purge control. Then, a further decision is made in step Q8 as to whether a required fuel vapor purge rate (RPR) for the canister 23 is not zero (0). If the answer to this decision is no, this indicates that there is no demand for fuel vapor purge. Then, the routine jumps over to step Q12 so as to prohibit fuel vapor purge. If the answer is yes, the canister 23 needs a quantity of fuel vapor. Then, a further decision is made, in step Q9, to judge whether or not the present engine operating condition is not in the learnable state (LST), in which the air-fuel ratio learning control can be conducted. If the answer to the decision is yes, indicating that the present engine operating condition is out of the state for the air-fuel ratio learning control and that no air-fuel ratio learning control is in any way being conducted, then, the fuel vapor purge is conducted and carried in step Q11.

If the answer to the decision made in step Q9 is no, this indicates that both the air-fuel ratio learning control and the fuel vapor purge may be conducted. Then, proceeding to step Q10, a final decision is made as to whether the engine operating condition is in a state of the air-fuel ratio learning control and the purge execution flag CPGFB is not in the prohibit state, namely, is set to the permission state (CPGFB=1). If the answer is yes, this indicates that the air-fuel ratio learning control is prohibited. Then, the fuel vapor purge is conducted and carried out in step Q11. However, if the answer to the decision in step Q10 is no, indicating that the purge execution flag CPGFB is in the prohibit state (CPGFB=0) and, accordingly, the system is currently undergoing the air-fuel learning control, then, the execution of fuel vapor purge is prohibited in step Q12. Either step Q11 or step Q12 orders return to the main program.

Therefore, the fuel vapor purge is carried out in the region of engine operating conditions set for fuel vapor purge which forms at least a part of the air-fuel ratio learning control region shown in FIG. 3. Further, in the overlap of the region for the air-fuel ratio learning control and the fuel vapor purge, which coincides with the whole region of the fuel vapor purge, the engine control system executes the air-fuel ratio learning control and resets the purge execution flag CPGFB to the prohibit state (CPGFB=0). Consequently, the fuel vapor purge is prohibited for a predetermined number of reversals of the output of the exhaust sensor 35 after the last renewal of a learned correction value. When renewing a learned correction value and prohibiting the air-fuel ratio learning control, the purge execution flag CPGFB is set to the permission state (CPGFB=1) so as to carry out the fuel vapor purge. In this manner, the air-fuel ratio learning control and the fuel vapor purge are alternately conducted and carried out.

As described above in connection with the flow charts shown in FIGS. 4 and 5, in a case in which the engine operation condition falls in the high engine load, high vehicle speed range, in which the hot wire type air flow sensor 35 has a large air flow detection error, the air-fuel ratio learning control is conducted prior to the fuel vapor purge. Further, in a case in which the engine operation condition falls in the high engine load, high vehicle speed range, the purge execution flag CPGFB is reset to the prohibit state (CPGFB=0) so as to suspend the execution of fuel vapor purge until an error in the feedback correction value CFB becomes less than 1% of the predetermined correction value. In addition, in the overlapping region which is the same region as for the fuel vapor purge, since the engine control system repeatedly and alternately conducts the air-fuel ratio learning control and the fuel vapor purge at a given frequency for a predetermined number of reversals of the output of the exhaust sensor 35, during the air-fuel ratio learning control, the calculation of learned correction values CLARN is free from fuel vapor.

In the high engine load, high vehicle speed region H-P, in which the hot wire type of air flow sensor 35 exhibits a large error of detection or a low detection accuracy, because the fuel injector 16 delivers a quantity of fuel smaller than the quantity of fuel determined according to an actual quantity of intake air, an error in detecting the air-fuel ratio may easily occur. However, according to the engine control system of the resent invention, in the high engine load, high vehicle speed region, because the air-fuel ratio learning control is conducted prior to the fuel vapor purge until the feedback correction value CFB of air-fuel ratio converges to within 1% of the predetermined air-fuel ratio, the learning value CLARN reaches an appropriate value in a short period of time. This results in the air-fuel ratio of the air and fuel mixture quickly converging to a target value in a short period of time.

Figure 6:
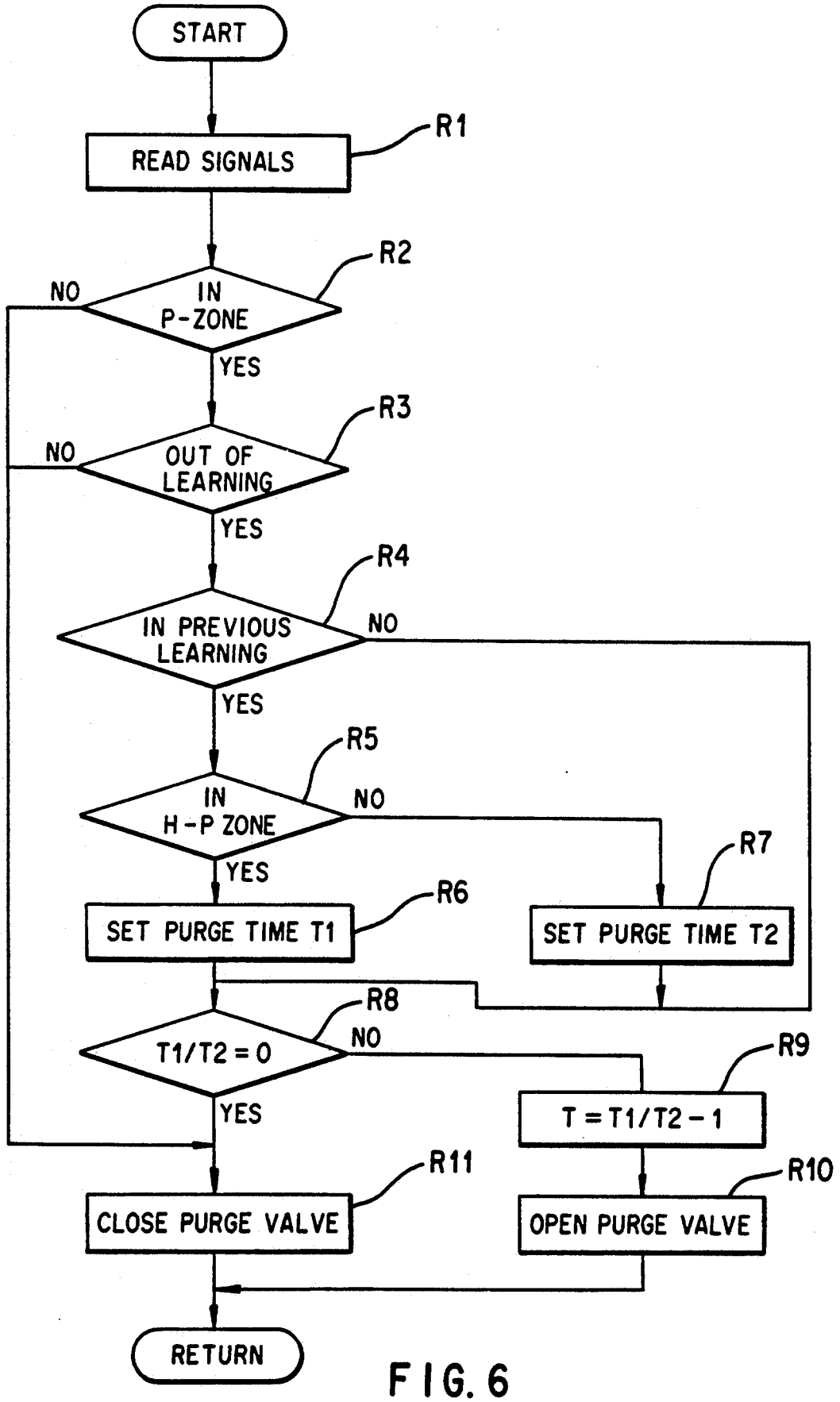
FIG. 6 is a flow chart illustrating a sequence of a fuel vapor purge for CPU used in an engine control system in accordance with another preferred embodiment of the present invention.

Referring to FIG. 6, a flow chart illustrating an air-fuel ratio learning control sequence in accordance with another preferred embodiment is shown. In this sequence, a period of time in which fuel vapor purge is executed is set short in a high engine load, high vehicle speed region (shown by H-P in FIG. 3), in which the hot wire type of air flow sensor 35 exhibits a large detection error or a low detection accuracy.

Briefly, after starting, the first step in FIG. 6 is to read various signals in step R1 to determine the present operating condition of the engine. Then, a decision is made in step R2 as to whether the engine operating condition is in the fuel vapor purge zone P shown in FIG. 3. If the answer to the decision is yes, indicating that the engine operating condition is in the purge execution region P, a decision is made in step R3 as to whether the air-fuel ratio learning control is not being executed. If the engine operating condition is not being executed, then a decision is further made in step R4 as to whether the previous air-fuel ratio learning control is still being performed. If the answer to the decision in step R4 is yes, this indicates that the yes decision in step R2, indicating that fuel vapor purge is being performed, is provided for the first time in the current control sequence. Before conducting the fuel vapor purge, a practical purge time is established. That is, as a result of a decision in step R5, when the engine operating condition is falls in the high engine load, high vehicle speed region H-P in FIG. 3, a purge time counter, such as a down counter, in the CPU is set to a small count T1, corresponding a short period of time, in step R6. On the other hand, when the engine operating condition is out of the high engine load, high vehicle speed region H-P, the purge time counter in the CPU is set to a large count T2, corresponding a long period of time and larger than the small count T1, in step R7. Thereafter, in any case, a decision is made in step R8 as to whether the purge time counter has counted down the purge time T1 or T2. When the purge time T1 or T2 has not fully lapsed or been counted down to zero (0), after changing the purge time T1 or T2 by an decrement of one (1) in step R9, the purge valve 24 is opened in step R10 so as to purge fuel vapor into the intake passage 7. The purge valve 24 remains open until the purge time T1 or T2 has fully lapsed, If the purge time counter has counted down to zero (0), then, the purge valve 24 is closed in step R11.

If the answer to either one of the decisions in steps R2 and R3 is no, the purge valve 24 is immediately closed in step R11. If the answer to the decision in step R4 is no, indicating that the previous air-fuel ratio learning control has been completed, the purge time counter has already been set to either the short purge time T1 or the long purge time T2, and the control routine jumps to step R8 to decide whether the purge time counter has fully counted down to zero (0).

According to the engine control system in accordance with this particular embodiment of the present invention, in the high engine load, high vehicle speed region H-P, in which the hot wire type of air flow sensor 13 has a low detection accuracy, the fuel vapor purge is completed in a purge time period T1, which is shorter than a purge time period T2 set for the ordinary purge execution region P, so that the routine of the air-fuel ratio learning control is repeated quickly and more frequently, thereby causing an air-fuel ratio to converge rapidly with the target ratio.

It is to be understood that although the present invention has been fully described with respect to preferred embodiments thereof, various other embodiments and variants which fall within the scope and spirit of the invention are possible, and it is intended that such other embodiments and variants be covered by the following claims.

What is claimed:

1. An engine control system for correcting an air-fuel ratio of an air and fuel mixture in feedback control for an automotive engine equipped with an intake system which has a hot wire type of air flow sensor for detecting an air flow rate of intake air introduced into the intake system, said engine control system comprising:

air-fuel ratio learning means for learning an air-fuel ratio of a mixture and renewing said air-fuel ratio in a predetermined learning region of engine operating conditions so as to control said air-fuel ratio in a learning control;

purge means for purging fuel vapor into said intake system in a predetermined purge region of engine operating conditions, at least a portion of said predetermined purge region overlapping with said predetermined learning region, said air-fuel ratio learning means and said purge means being alternately operated at a predetermined frequency when an engine operating condition is in said portion of said predetermined purge region overlapping with said predetermined learning region;

detecting means for detecting engine operating conditions in a predetermined specific region of engine operating conditions in which the engine needs intake air at high flow rate; and control means for causing said air-fuel ratio learning means to operate prior to said purge means when said detecting means detects an engine operating condition in said predetermined specific region.

2. An engine control system as recited in claim 1, wherein said control means prohibits said feedback control while causing said air-fuel ratio learning means to operate prior to said purge means.

3. An engine control system as recited in claim 1, wherein said control means prohibits operation of said purge means until a feedback correction value in said feedback control becomes smaller than a predetermined value when said detecting means detects an engine operating condition in said predetermined specific region.

4. An engine control system as recited in claim 1, wherein said control means causes said purge means to be active for a longer period of time when an engine operating condition is in said predetermined purge region and a shorter period of time when an engine operating condition is in said predetermined specific region.

5. An engine control system as recited in claim 1, further comprising exhaust sensor means, providing an electric output repeatedly reversing in level according to oxygen levels, for monitoring an oxygen content of exhaust of the automotive engine to detect an oxygen content of said exhaust.

6. An engine control system as recited in claim 5, wherein said air-fuel ratio learning means executes learning of an air-fuel ratio when said exhaust sensor means is sufficiently activated, under normal operating conditions, for air-fuel ratio detection.

7. An engine control system as recited in claim 6, wherein said exhaust sensor means is determined to be in an abnormal operating condition when said electric output remains unchanged in level for longer than a predetermined period of time.

8. An engine control system as recited in claim 5, wherein said air-fuel ratio learning means is caused to learn an air-fuel ratio after said exhaust sensor means reverses said electric output more than a predetermined number of times.

9. An engine control system as recited in claim 8, wherein said air-fuel ratio learning means is caused to learn an air-fuel ratio when said detecting means detects an engine operating condition is in said predetermined specific region while said exhaust sensor means has reversed said electric output less than a predetermined number of times.

10. An engine control system as recited in claim 9, wherein said air-fuel ratio learning means is prohibited from learning an air-fuel ratio when a feedback correction value in said feedback control has a deviation within 1% of a desired air-fuel ratio while said exhaust sensor means has reversed said electric output less than a predetermined number of times and said detecting means detects an engine operating condition in said predetermined specific region.

11. An engine control system as recited in claim 1, wherein each predetermined region is defined by engine load and vehicle speed.

12. An engine control system as recited in claim 11, wherein said predetermined purge region is included in said predetermined learning region at higher engine loads and higher vehicle speeds in said predetermined learning region.

13. An engine control system as recited in claim 12, wherein said predetermined specific region is included in said predetermined purge region at higher engine loads and higher vehicle speeds in said predetermined purge region.

* * * * *